US008375858B2

(12) United States Patent
Steadman, Sr.

(10) Patent No.: US 8,375,858 B2
(45) Date of Patent: Feb. 19, 2013

(54) FIREWORKS LAUNCHING STAND

(76) Inventor: Alfonza Steadman, Sr., Akron, OH (US)

( * ) Notice: Subject to any disclaimer, the term of this patent is extended or adjusted under 35 U.S.C. 154(b) by 180 days.

(21) Appl. No.: 12/841,387

(22) Filed: Jul. 22, 2010

(65) Prior Publication Data

US 2011/0017088 A1 Jan. 27, 2011

Related U.S. Application Data

(60) Provisional application No. 61/227,618, filed on Jul. 22, 2009.

(51) Int. Cl.
*F42B 4/20* (2006.01)

(52) U.S. Cl. ..... 102/358; 102/343; 102/349; 211/60.1; 211/196; 248/519; 248/528; 248/121; 248/166

(58) Field of Classification Search ..... 102/358, 102/343, 349, 335, 336, 361; 248/519, 528, 248/121, 166; 211/60.1, 85.7, 70.6, 70.8, 211/196, 197, 205, 1.3, 13.1
See application file for complete search history.

(56) References Cited

U.S. PATENT DOCUMENTS 2,220,407 A * 11/1940 Joss ..... 246/488
4,771,695 A 9/1988 Simpson
5,567,907 A * 10/1996 Westfall ..... 102/344
7,011,220 B2 3/2006 Deye
7,086,530 B2 * 8/2006 Price et al. ..... 206/477
7,191,729 B2 * 3/2007 DeGroat, Jr. ..... 116/63 P

FOREIGN PATENT DOCUMENTS

EP 1 499 849 B1 1/2007

OTHER PUBLICATIONS

Joe Zastrow's Sturdy Firework Stand, http://www.pyrouniverse.com/show/fprojects/sturdy.htm, accessed Jun. 9, 2009, 11 pgs.
Joe Zastrow's Cross Arm, http://www.pryouniverse.com/show/fprojects/cross.htm, accessed Jun. 9, 2009, 4 pgs.
Mister Standman Music Stands & Book Stands, http://www.misterstandman.com/dimmens,htm, accessed Jun. 9, 2009, 7 pgs.

* cited by examiner

*Primary Examiner* — James Bergin
(74) *Attorney, Agent, or Firm* — Fay Sharpe LLP; George P. Huang

(57) ABSTRACT

A fireworks launching stand comprises a post, a cap attached to a top of the post, and at least one horizontal arm attached to the cap. The horizontal arm can be tilted. Fireworks tubes suitable for use with rockets and/or Roman candles are attached to the horizontal arm. The use of the stand reduces the risk of injury to the user due to improper handling of lit fireworks.

17 Claims, 6 Drawing Sheets

FIG. 3
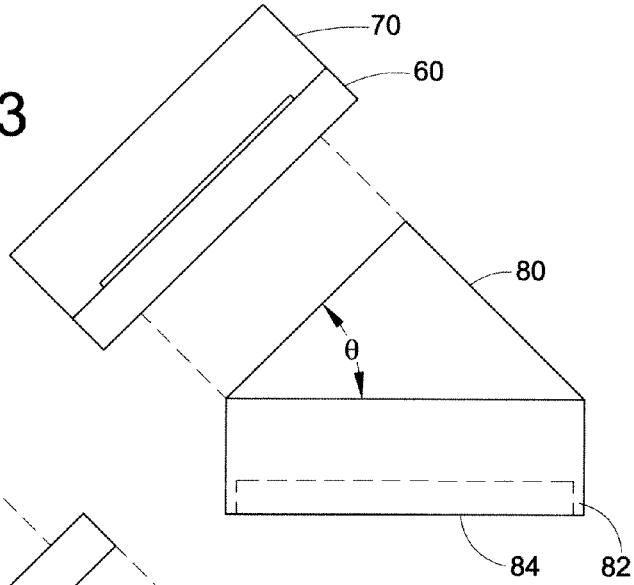
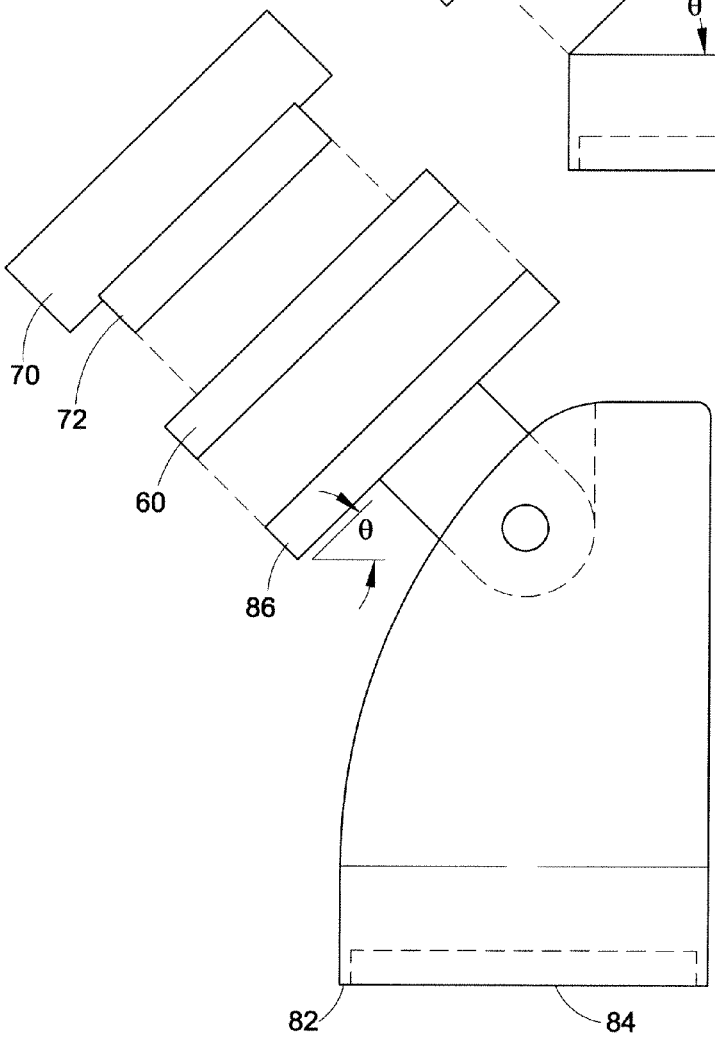
FIG. 7

FIREWORKS LAUNCHING STAND

This application claims priority to U.S. Provisional Patent Application Ser. No. 61/227,618, filed Jul. 22, 2009. The disclosure of that provisional application is hereby fully incorporated by reference herein.

BACKGROUND

The present disclosure relates to a fireworks launching stand. Several different aspects and embodiments are described. Such stands may be helpful in reducing injury and/or damage due to improper and unsafe fireworks use.

Several types of fireworks are offered/sold to consumers. Two types include "Roman candles" and rockets. Generally speaking, a Roman candle is a firework in which pyrotechnic stars are stacked on top of each other. The fuse is ignited from the top and as the flame burns downwards, each pyrotechnic star is ignited in turn and shoots out the top of the Roman candle.

A rocket propels itself up into the sky and provides an explosive display and/or report. It is generally cylindrically shaped and contains an explosive and a fuse. Usually, the fuse is at the base of the rocket. The rocket also has an attached, elongated rod or stick to provide both stability during flight and a means for holding the rocket to allow ignition of the fuse.

Fireworks can be dangerous if improperly handled. The possibility of harm can be reduced by using a fireworks stand to position the firework before and during ignition. The stand can reduce the likelihood that the firework travels in an errant trajectory. It also allows the user to place the firework somewhere after it is lit and to move away from the firework, thus reducing personal injuries.

There remains a need for additional devices and methods by which injury to fireworks users can be reduced.

BRIEF DESCRIPTION

The present disclosure relates to fireworks launching stands. The fireworks launching stands are particularly suited for use with Roman candles and/or rockets.

Disclosed in some embodiments is a stand for launching fireworks comprising: a post; a plurality of legs connected to a bottom of the post and adapted to define a plane perpendicular to the post; at least one horizontal arm operatively connected to a top of the post and tilted with respect to the plane; and at least one fireworks tube attached to the horizontal arm.

Several types of fireworks tubes may be used. In one type, the fireworks tube is hollow and capped at a bottom end. In another type, the fireworks tube is hollow and has a top bar across a top end. This type may also have a bottom bar across a bottom end. In a third type, the fireworks tube is hollow and has a bar extending through the tube that divides the tube into two hemicylindrical parts.

The legs may be adapted to fold against the post, and the stand further comprises braces for locking the legs into the plane.

The fireworks tube may have a length of from 2 inches to 13.5 inches.

In some embodiments, the post is hollow, and a height of the post is greater than a length of the horizontal arm.

The post can have a square cross-section. In particular versions, each side of the post has a length of from about 3.5 inches to about 4 inches.

In additional embodiments, the horizontal arm is connected to a cap, and the cap connects to the top of the post. The cap can be adapted to allow the horizontal arm to be tilted between a range of 45 degrees and 90 degrees. The base of the cap can be adapted to fit over the top of the post. Alternatively, the base of the cap is adapted to fit inside the top of the post.

In some versions, the legs define a span, and the span is greater than the length of the horizontal arm. The horizontal arm length may also be less than a height of the post.

In certain versions, the fireworks tube comprises a male connector and the horizontal arm comprises a plurality of female connectors. This allows the fireworks tube to be removed and attached at different locations on the horizontal arm.

The bottom of the post and the legs are sometimes weighted so that the stand has a center of gravity below a midpoint of the stand. The stand may have a weight of from about 10 pounds to about 15 pounds.

In other embodiments is disclosed a stand for launching fireworks comprising: a hollow post having a post height, a post side length, and a post diagonal length; four legs attached to a bottom end of the post that can fold down to define a plane perpendicular to the post; a cap at a top end of the post; a horizontal arm attached to the cap at an angle to the plane and having an arm length and an arm height; and one or more fireworks tubes attached to the horizontal arm; wherein the horizontal arm length is less than the post height and the arm height is about equal to the post diagonal length.

The ratio of the arm height to the post diagonal length can be from about 0.9 to 1.

Also disclosed are other embodiments of a stand for launching fireworks comprising: a hollow post; legs attached to the post that fold down into a down position; a horizontal arm connected to a cap at a top of the post; and first and second fireworks tubes attached to the horizontal arm; the first fireworks tube being hollow and capped at a bottom end; the second fireworks tube being hollow and having a bar across a top end; wherein the horizontal arm is adapted to tilt at angles between 45° and 90° with respect to a plane defined by the legs in the down position.

Additionally contemplated is a kit, comprising: a post; a base which is perpendicular to the post; a cap which can be connected to the post; a horizontal arm which can be connected to the cap and comprising a plurality of connectors; a first fireworks tube which is hollow, capped at a bottom end, and can be connected to a horizontal arm connector; and a second fireworks tube which is hollow, has a bar across a top end, and can be connected to a horizontal arm connector.

These and other non-limiting aspects of the present disclosure are further discussed herein.

BRIEF DESCRIPTION OF THE DRAWINGS

The following is a brief description of the drawings, which are presented for the purpose of illustrating the exemplary embodiments disclosed herein and not for the purpose of limiting the same.

FIG. 3 is a side view of one exemplary embodiment of a cap used on the fireworks launching stand of the present disclosure.

FIG. 7 is a side view of another exemplary embodiment of a cap used on the fireworks launching stand of the present disclosure.

DETAILED DESCRIPTION

Figure 1:
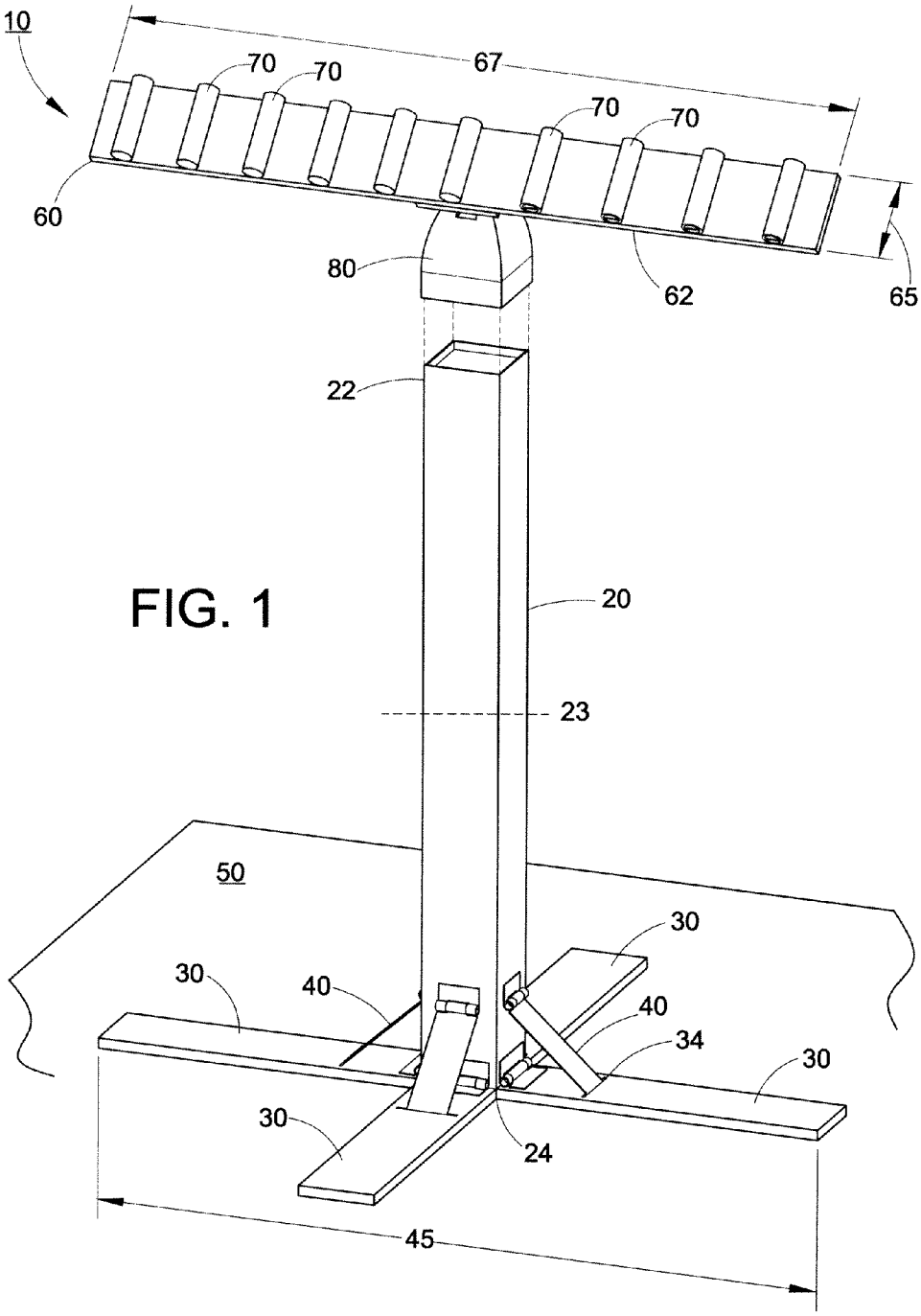
FIG. 1 is a perspective view of a fireworks launching stand of the present disclosure.

A more complete understanding of the components, processes, and apparatuses disclosed herein can be obtained by reference to the accompanying figures. These figures are merely schematic representations based on convenience and the ease of demonstrating the present development and are, therefore, not intended to indicate relative size and dimensions of the devices or components thereof and/or to define or limit the scope of the present disclosure.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range from about "2 to about 4" also discloses the range "from 2 to 4."

The fireworks launching stands of the present disclosure generally include a post and a horizontal arm operatively connected to the post. The horizontal arm is tilted with respect to the base of the post. One or more fireworks tubes, having particular structures as described further herein, are attached to the horizontal tube for holding fireworks.

Figure 2:
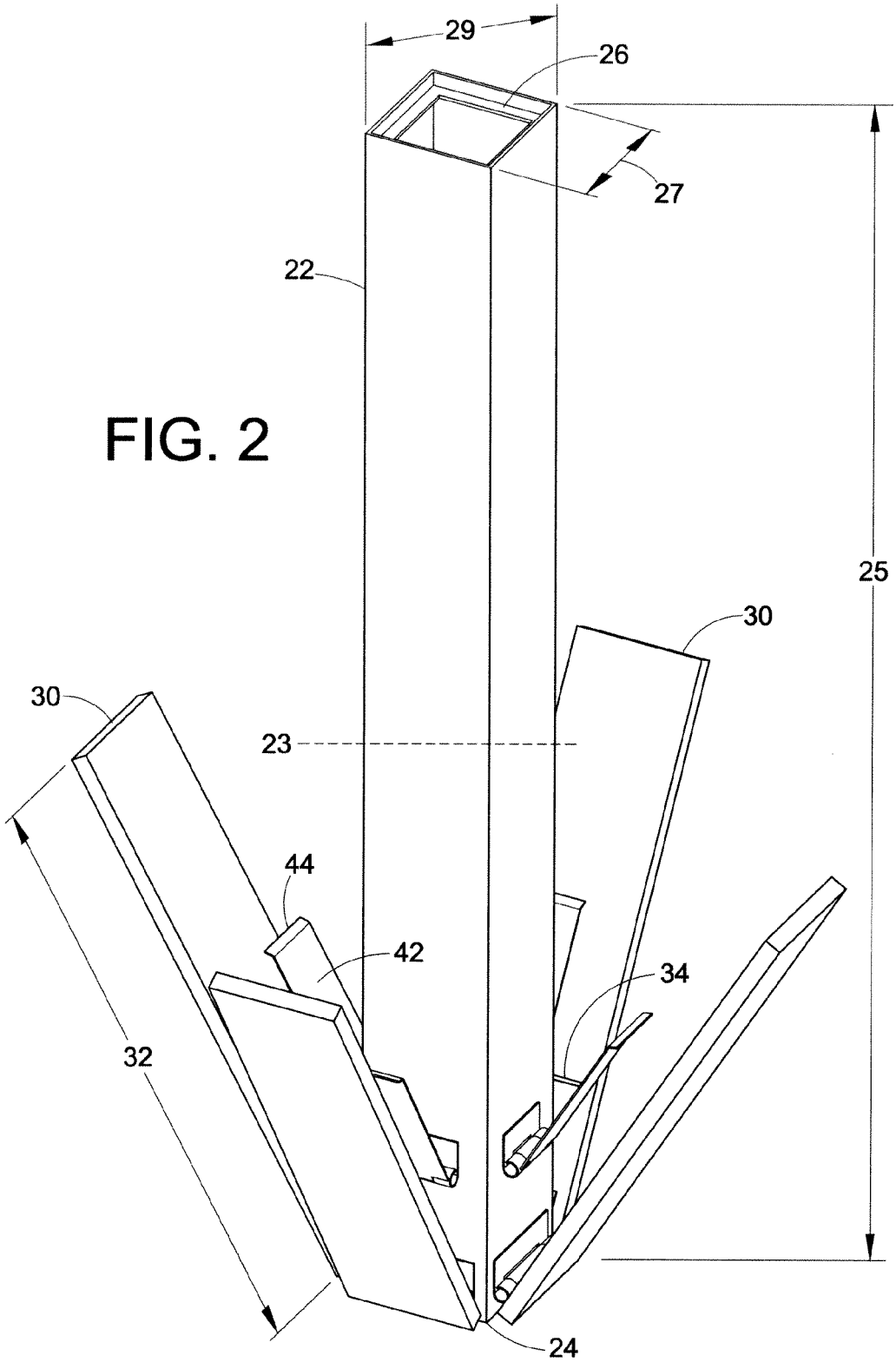
FIG. 2 is a perspective view of an exemplary post used to form the fireworks launching stand of the present disclosure.

FIG. 1 is a perspective view showing the various parts of the fireworks launching stand 10. A body or post 20 has a top end 22 and a bottom end 24. At the bottom end is a plurality of legs 30. As shown here, the body or post has four legs. Each leg has a brace 40. The brace is attached to the post above the leg. The free end 42 of the brace is bent and forms a plug 44 that fits into a slot 34 on the leg to lock the leg in place, i.e. support the leg. As seen in FIG. 2, the legs 30 and braces 40 can be folded up against the post 20. Put another way, the legs can fold down from an up position to a down position. The legs, when folded down, define a plane 50 which is substantially perpendicular (i.e. normal) to the post 20. Put another way, the plane 50 defines an x-axis and a y-axis, and the post 20 is the z-axis.

A horizontal arm 60 is operatively connected to the top end 22. The arm 60 is tilted with its lower surface 62 at an angle θ (see FIGS. 3 and 7). One or more fireworks tubes 70 are attached to the horizontal arm 60. The horizontal arm 60 is attached to a cap 80, which is then attached to the post 20. It should be noted that the horizontal arm 60 extends across opposite sides of the post 20. This increases stability of the overall stand when fireworks are used. While the horizontal arm is depicted here as a single integral piece, it is contemplated that the horizontal arm could be assembled from two or more separate pieces.

In FIG. 1, the cap 80 has a recess 82 that fits over the top end 22 of the post 20. However, as seen in FIG. 2, the post 20 may alternatively be configured with, for example, an interior shelf 26 (i.e. on the inside of the post) so that the base 84 of the cap 80 fits inside the top 22 of the post and rests on the interior shelf. As also seen in FIG. 2, the post 20 may be hollow for a substantial portion of its height (the bottom end 24 being closed or capped so that items do not fall out). It is contemplated that, for example, the horizontal arm 60 and cap 80 can be disassembled and then stored inside the post 20.

Figure 4:
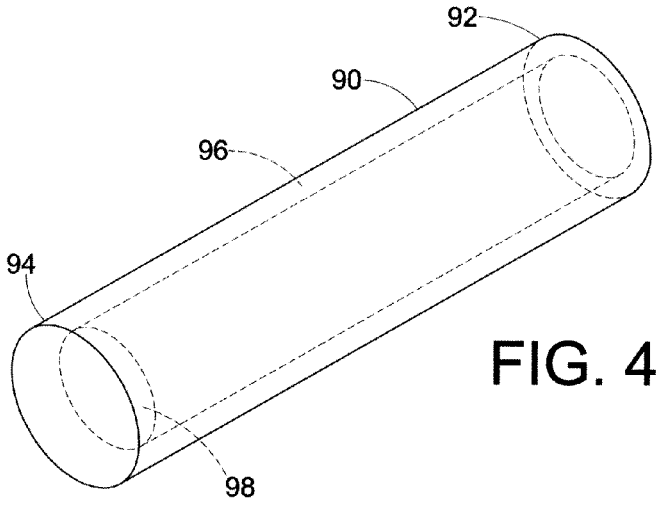
FIG. 4 is a diagram of one type of fireworks tube used on the fireworks launching stand of the present disclosure which is suitable for Roman candles.

Two different types of fireworks tubes can be used on the fireworks launching stand 10. FIG. 4 shows a tube that can be used with Roman candles. The tube 90 has a top end 92 and a bottom end 94. The tube is generally hollow, i.e. the top end 92 exposes the interior of the tube. The bottom end 94 is capped to support the Roman candle. Described another way, the tube 90 is formed from a cylindrical sidewall 96 and a cap 98 at one end.

Figure 5:
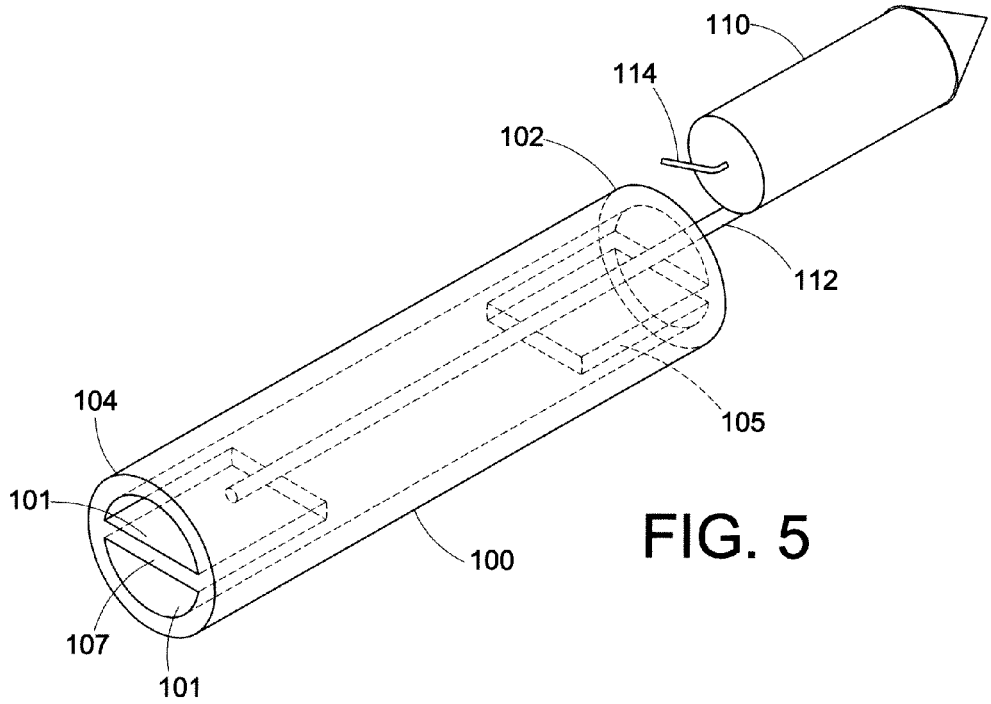
FIG. 5 is a diagram of one type of fireworks tube used on the fireworks launching stand of the present disclosure which is suitable for rockets.

FIG. 5 shows a tube that can be used with rockets. The tube 100 has a top end 102 and a bottom end 104. Again, the tube is hollow. Here, the tube is exposed at both ends. A top bar 105 crosses the top end, dividing the tube 100 roughly into two functionally hemicylindrical parts 101. If desired, a bottom bar 107 can also be present at the bottom end; however, the bottom bar is not needed. Described another way, the tube 100 is formed from a cylindrical sidewall 108 and has bars 105, 107 at one or both ends.

As shown here, the tube 100 has two bars, and the two bars do not connect inside the tube. In some embodiments, each bar has a length of about 1 inch. However, if desired, a single bar may extend through the entire tube between the top end 102 and the bottom end 104. It is intended that the stick 112 typically attached to a rocket 110 is inserted into the tube 100 on one side of the bars so that the fuse 114 remains outside of the tube for easy access. One function of the bars 105, 107 is to prevent the generally cylindrical-shaped rocket 110 from otherwise falling through the bottom end 104 of the tube when lit by making the top end 102 too small for the rocket to fit.

The tubes may have a length of from about 2 inches to about 13.5 inches, but typically have a length of between 4 inches and six inches, particularly about 5.5 inches. They can also have a diameter of from about 0.25 inches to about 3 inches, though they typically have a diameter of about 1 inch. The fireworks launching stand is depicted in these figures as having 10 tubes; however, the number of tubes may vary. In particular embodiments, the fireworks launching stand 10 has at least two tubes. In addition, the two types of tubes 90, 100 can be arranged in any order along the horizontal arm 60. In particular embodiments, both types of tubes are provided. However, embodiments are contemplated where only one type of tube (either 90 or 100) are used.

The post 20 has, in particular embodiments, a square or rectangular cross-section. One advantage of these two cross-sectional shapes is that the diagonal length can be appreciably longer than the side length. If the horizontal arm 60 is suitably dimensioned, then when placed inside the hollow post 20, the cross-sectional shape will prevent the horizontal arm from moving too freely within the post. As noted in FIGS. 1 and 2, the post 20 has a post height 25, a post side length 27, and a post diagonal length 29. The horizontal arm 60 has a horizontal arm length 67 and a horizontal arm height 65. In some embodiments, the horizontal arm length 67 is less than the post height 25.

The arm height may be between the post side length and the post diagonal length. In some embodiments, the arm height is about equal to the post diagonal length. In particular, the ratio of the arm height to the post diagonal length may be from about 0.9 to 1.

Together, the legs 30 form a base for supporting the horizontal arm above the ground. It should be remembered that when the fireworks are lit, they will exert torque about the axis defined by the post 20. Thus, in some embodiments, the length 67 of the horizontal arm 60 should be equal to or less than the span 45 of the legs (see FIG. 1). Put another way, the span of the legs 45 is greater than the horizontal arm length 67. The span should be measured as the distance parallel to the horizontal arm that is covered by the legs.

However, it is possible for the horizontal arm length 67 to exceed the span 45 as long as the ratio between the two is not so high that the torque would cause the stand 10 to tip over upon lighting a firework. As discussed above, the ratio of the horizontal arm length 67 to the span 45 should generally be 1:1 or lower. However, in some embodiments, the ratio may be up to 1.2:1.

As depicted in FIG. 1, the span 45 would be the sum of two leg lengths 32 and the post side length 25. It is contemplated that other arrangements of legs and/or braces may be used as well. The function of the legs is to form a supporting plane that is normal (i.e. perpendicular) to the post or body 20. Thus, in some embodiments, there are three or more legs oriented at angles to each other to define a plane. While all legs typically have the same length 32, versions are contemplated where, for example, a first pair of legs have the same length and a second pair of legs have a length different from the first pair.

The post 20 may have a post height 25 of from about 24 inches to about 54 inches. Generally speaking, this range of heights allows fireworks to be loaded without bending over too far forwards or backwards. In particular embodiments, the post height is from about 36 inches to about 48 inches.

The post 20 may have a side length 27 of from about 3 inches to about 6 inches, including from 3.5 inches to about 4 inches. The post needs to be strong enough to support the horizontal arm, and thus should not be too thin or narrow. Thus, in embodiments, the post diagonal length may be from about 4 inches to about 9 inches.

The horizontal arm 60 may have an arm length 67 of from about 6 inches to about 100 inches, but is generally from about 36 inches to about 48 inches. The horizontal arm may have an arm height 65 of from about 2 inches to about 8 inches, including from about 4 inches to about 6 inches.

Each leg 30 may have a length of from about 8 inches to about 50 inches, and is usually shorter than the post height 25. In particular embodiments, each leg length 32 is from about 12 inches to about 24 inches. The span 45 may thus be from about 19 inches to about 106 inches.

The fireworks launching stand 10 should also have a low center of gravity, so that it is not easily tipped over or blown over by the igniting fireworks. In embodiments, the stand has a weight of from about 10 pounds to about 15 pounds (approximately 4.5-6.8 kg). The bottom end 24 of the post and the legs 30 can be weighted so that the center of gravity is below the midpoint 23 of the post.

Figure 6:
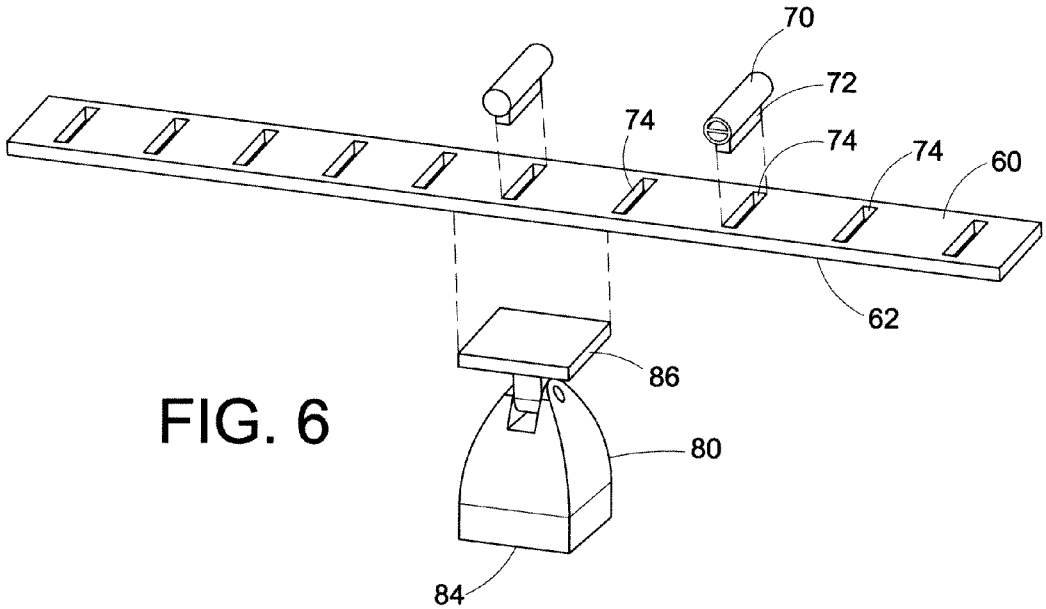
FIG. 6 is a perspective view showing different aspects of various embodiments of the fireworks launching stand of the present disclosure.

As shown in FIG. 6, the horizontal arm 60 and fireworks tubes 70 can be configured so that the types of tubes can be located along the horizontal arm as desired by the user. The fireworks tube 70 may have a male connector 72 which engages a female connector 74 located on the horizontal arm. As seen here, the horizontal arm comprises a plurality of female connectors 74.

As shown in FIGS. 6 and 7, it is contemplated that the horizontal arm 60 can be separated from the cap 80 to facilitate packing or storage of the components within the interior of the post 20. For example, the horizontal arm 60 may be connected to a platform 86 on the cap 80. They can be connected/disconnected using known means, such as fasteners, screws, slots, etc. In other particular embodiments, though, the horizontal arm 60 and cap 80 are permanently joined together.

It is also contemplated that in some embodiments, the cap 80 allows the horizontal arm 60 to be tilted between a range of angles θ. As shown in FIGS. 3 and 7, the angle θ is defined with respect to (i) the plane 50 defined by the legs 30 and (ii) the plane defined by the horizontal arm 60. In particular embodiments, the horizontal arm can be tilted between a range of 45 degrees and 90 degrees (i.e. vertical). This range of motion generally reduces the risk that igniting fireworks will, for example, shoot horizontally and hit a person in the head or chest. In some embodiments, the horizontal arm is fixed at an angle of 45 degrees.

Figure 8:
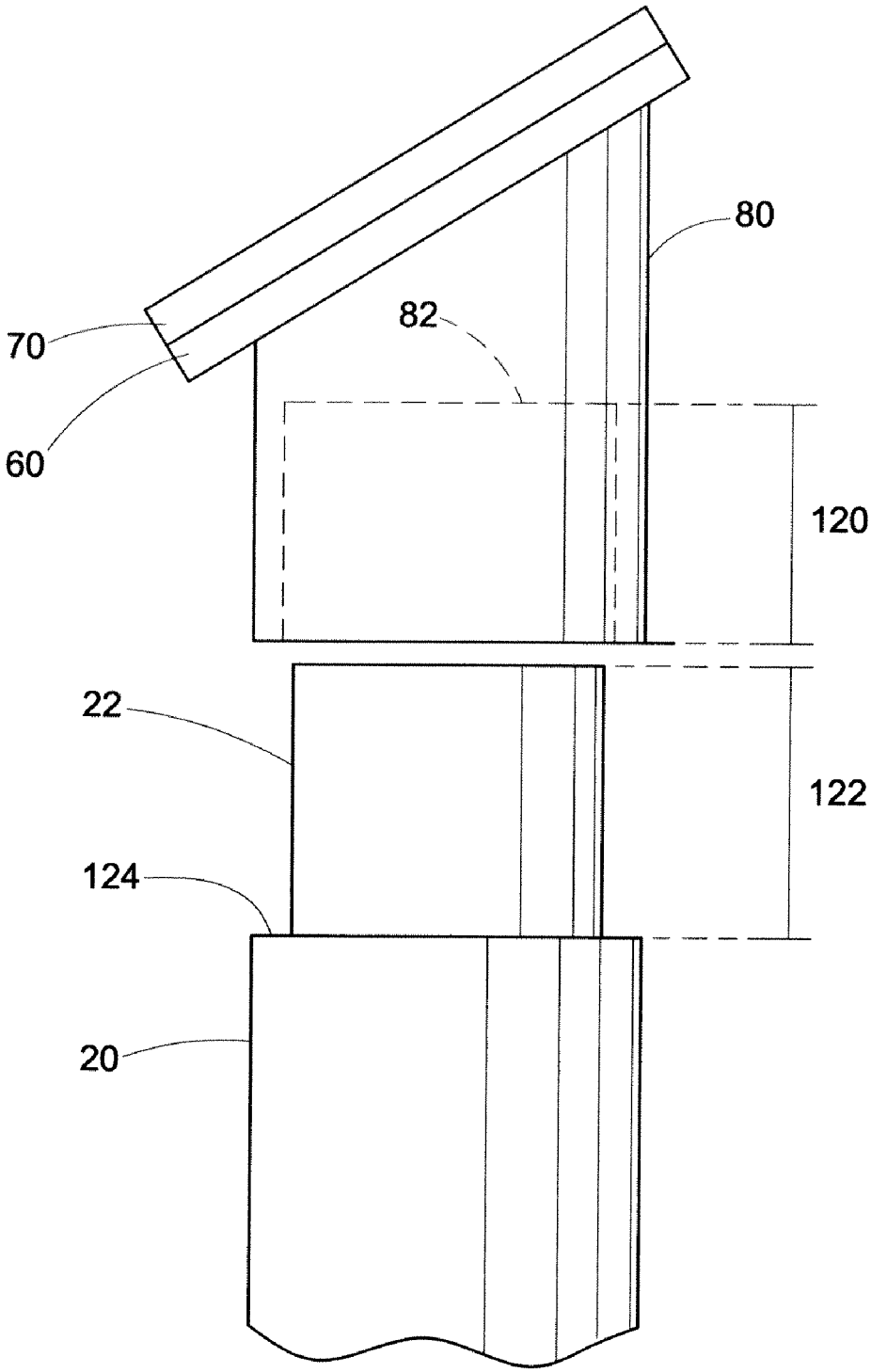
FIG. 8 is a side view of another exemplary embodiment of a cap used on the fireworks launching stand of the present disclosure.

FIG. 8 is another embodiment showing the post 20 and a cap 80. Here, the top end 22 of the post is narrower than the remainder of the post, forming an exterior shelf 124 on which the cap rests. The top end 22 of the post is firmly inserted into recess 82 of the cap. Put another way, the length 122 of the top end 22 is substantially equal to the depth or length 120 of the recess 82. Here, the horizontal arm 60 is fixed at an angle of 45 degrees. It should be noted that in embodiments, the top end 22 of the post is not hollow, but instead is somewhat solid, to provide a better connection between the post and the cap. In embodiments, the top end of the post is I-shaped when viewed from the top, with a bar traversing the interior of the post.

Generally, the various pieces of the fireworks launching stand can be made from any suitable materials. Preferably, the fireworks tube(s) are made from relatively inflammable material, such as vinyl tubing. Other suitable materials for the various pieces may include, wood, metal, etc.

EXAMPLE

A prototype fireworks launching stand was built and is substantially illustrated in FIG. 1. The post height was 39 inches, the post side length was about 3.5-4 inches, and the post diagonal length was about 4 inches. The horizontal arm length was 40 inches. The horizontal arm height was about 5.5 inches. Each leg had a length of about 16 inches, and the span was about 36.5 inches. 10 tubes were spaced substantially evenly over the length of the horizontal arm. The horizontal arm was fixed to the cap at an angle of 45 degrees, and the cap fitted over the top end of the post. Four legs folded down and were each locked in place by a brace.

The devices of the present disclosure have been described with reference to exemplary embodiments. Obviously, modifications and alterations will occur to others upon reading and understanding the preceding detailed description. It is intended that this disclosure be construed as including all such modifications and alterations insofar as they come within the scope of the appended claims or the equivalents thereof.

The invention claimed is:

1. A stand for launching fireworks comprising:

a post;

a plurality of legs connected to a bottom of the post and adapted to define a plane perpendicular to the post;

at least one horizontal arm operatively connected to a top of the post and tilted with respect to the plane; and at least one fireworks tube attached to the horizontal arm;

wherein either (a) the at least one fireworks tube is hollow and has a top bar across a to end; or (b) the at least one fireworks tube is hollow and has a to bar across a top end and a bottom bar across a bottom end; or (c) the at least one fireworks tube is hollow and has a bar extending through the tube that divides the tube into two hemicylindrical parts.

2. The stand of claim 1, wherein the legs are adapted to fold against the post, and the stand further comprises braces for locking the legs into the plane.

3. The stand of claim 1, wherein the post is hollow, and a height of the post is greater than a length of the horizontal arm.

4. The stand of claim 1, wherein the horizontal arm is connected to a cap, and the cap connects to the top of the post.

5. The stand of claim 4, wherein the cap comprises a recess, and wherein the top of the post forms an exterior shelf, the top of the post being inserted into the recess of the cap.

6. The stand of claim 5, wherein a length of the top of the post is substantially equal to a depth of the recess of the cap.

7. The stand of claim 1, wherein the legs define a span, the horizontal arm has a horizontal arm length, and the span is greater than the horizontal arm length.

8. The stand of claim 1, wherein the bottom of the post and the legs are weighted so that the stand has a center of gravity below a midpoint of the stand.

9. A stand for launching fireworks comprising:

a post having a post height, a post side length, and a post diagonal length;

four legs attached to a bottom end of the post that can fold down to define a plane perpendicular to the post;

a cap at a top end of the post;

a horizontal arm attached to the cap at an angle to the plane and having an arm length and an arm height; and one or more fireworks tubes attached to the horizontal arm;

wherein the horizontal arm length is less than the post height and the arm height is about equal to the post diagonal length.

10. The stand of claim 9, wherein the ratio of the arm height to the post diagonal length is from about 0.9 to 1.

11. The stand of claim 9, wherein at least one of the fireworks tubes is hollow and capped at a bottom end.

12. The stand of claim 9, wherein at least one of the fireworks tubes is hollow and has a top bar across a top end.

13. The stand of claim 12, wherein the fireworks tube also has a bottom bar across a bottom end.

14. The stand of claim 9, wherein at least one of the fireworks tubes is hollow and has a bar extending through the tube that divides the tube into two hemicylindrical parts.

15. The stand of claim 9, wherein each of the fireworks tubes comprises a male connector and the horizontal arm comprises a plurality of female connectors, such that each fireworks tube can be moved between different locations on the horizontal arm.

16. The stand of claim 9, wherein the cap comprises a recess and wherein the top end of the post forms an exterior shelf, the top end of the post being inserted into the recess of the cap.

17. A stand for launching fireworks comprising:

a post;

legs attached to the post that fold down into a down position;

a horizontal arm connected to a cap at a top of the post; and first and second fireworks tubes attached to the horizontal arm;

the first fireworks tube being hollow and capped at a bottom end;

the second fireworks tube being hollow and having a bar across a top end;

wherein the horizontal arm is tilted at an angle with respect to a plane defined by the legs in the down position.

* * * * *